United States Patent [19]

Gebo

[11] Patent Number: 4,520,897

[45] Date of Patent: Jun. 4, 1985

[54] PORTABLE STEPS

[76] Inventor: George B. Gebo, 4645 E. Industrial St., #2-E, Simi Valley, Calif. 93063

[21] Appl. No.: 579,685

[22] Filed: May 14, 1984

[51] Int. Cl.[3] ..... E06C 7/08; E04G 1/28

[52] U.S. Cl. ..... 182/92; 182/46; 182/223; 182/228; 108/130

[58] Field of Search ..... 182/90, 91, 92, 228, 182/222, 223, 46, 155; 52/180, 181; 108/130

[56] References Cited

U.S. PATENT DOCUMENTS

| | | | |
|---|---|---|---|
| 471,626 | 3/1892 | Streeter | 182/90 |
| 2,619,154 | 11/1952 | Erickson | 108/130 |
| 2,703,741 | 3/1955 | Pucci | 108/130 |
| 4,125,175 | 11/1978 | Ernst | 52/182 |
| 4,373,609 | 2/1983 | Donato | 182/228 |
| 4,445,591 | 5/1984 | Mitchell | 182/92 |

*Primary Examiner*—Reinaldo P. Machado
*Attorney, Agent, or Firm*—Roger A. Marrs

[57] ABSTRACT

Portable steps are disclosed herein including a plurality of step rungs arranged next to each other in parallel side-by-side relationship wherein each step rung has an elongated rigid member intended to be stepped upon by a riser which incorporates a pair of ground engaging spikes at each end of the step rung adapted to penetrate into the ground for a given length determined by a releasable guage. The spikes are pivotally carried on the step rung which includes a shaped recess corresponding to the shape of the spikes for storage and transportation purposes.

2 Claims, 8 Drawing Figures

PORTABLE STEPS

BACKGROUND OF THE INVENTION

1. Field of the Invention

The present invention relates to portable steps and, more particularly, to a novel step rung intended to be included with a plurality of step rungs wherein each step rung is provided with pivoting spikes adapted to be embedded in the ground for supporting the rung thereon in a temporary manner.

2. Brief Description of the Prior Art

In the past, steps have been constructed across elevated ground levels in order to permit persons to travel along the steps from place to another up or down a particular incline. Usually, such steps are permanently installed on a hill, slope or other ramp-like terrain and such construction sometimes includes an elevated frame on which a plurality of rungs are placed or, in other instances, step rungs are themselves embedded in the earth in a particular arrangement and at different elevations so as to provide the needed steps. Stones are sometimes employed and are arranged in a similar fashion.

However, difficulties and problems have been encountered with such permanent installation inasmuch as, in some instances, the steps are required for only a short period of time and permanent installation is either too expensive, complex or not needed except for a short usage. When steps are not used, persons traveling over the terrain on an incline have a tendency to slip or slide on wet grass, damage or dirty clothing as well as shoes and experience awkward travel over such terrain. This is particularly true in the instance of handicapped person, invalids or elderly persons. Extreme difficulty is experienced when transversing terrain while carrying a load or burdened with heavy packages or boxes.

Therefore, a long standing need has existed to provide a portable stepping arrangement which may be deployed upon the slope or incline of irregular terrain so that persons may readily cross the terrain in relative ease. Such an arrangement must be capable of convenient installation and disassembly after the stepping arrangement is no longer needed. Also, storage and transportation of the stepping arrangement must be considered so total efficiency can be gained.

SUMMARY OF THE INVENTION

Accordingly, the above problems and difficulties are obviated by the present invention which provides a novel portable arrangement of step rungs so as to provide a continuous path upon which a user may step in order to transverse an irregular slope or incline. Each rung of the arrangement includes an elongated member having a pair of spikes pivotally carried on each end of the member adapted to penetrate into the ground when in use and adapted to rotate into storage recesses formed in each end of the member for storage and transportation purposes. Means are provided on selected ones of the spikes for limiting penetration into the ground so that the irregularity of the terrain can be accommodated. Means are provided on opposite ends of each of the step rungs for registration and indexing with adjacent ends of other step rungs so as to provide a tongue-in-groove connection therebetween in the event a wider arrangement of steps is required than the width of a single step rung.

Accordingly, the primary object of the present invention is to provide a novel arrangement of step rungs wherein each rung is readily positionable and supportable on an irregular terrain so as to provide a total arrangement of stepping rungs for a user requiring a temporary stepping arrangement to be provided across a sloping or inclined ground surface.

Another object of the present invention is to provide a novel stepping rung for use with a plurality of such rungs which includes means for penetrating the surface of the ground for support and which further includes means for limiting the amount of penetration whereby the stepping surface of the rung may be maintained level.

Another object of the present invention is to provide a novel stepping rung having spike means for ground penetration and which includes storage recesses for the spike means so that the rung may be readily shipped or transported in a convenient fashion.

Yet a further object of the present invention is to provide a novel means for releasably connecting step rungs in an arrangement so that the length of stepping surface is increased by such connection.

Yet another object of the present invention is to provide a novel means for limiting the penetration of a spike into the ground so that the depth of the spike is controlled whereby the stepping surface of a step rung is maintained level and flat for use.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
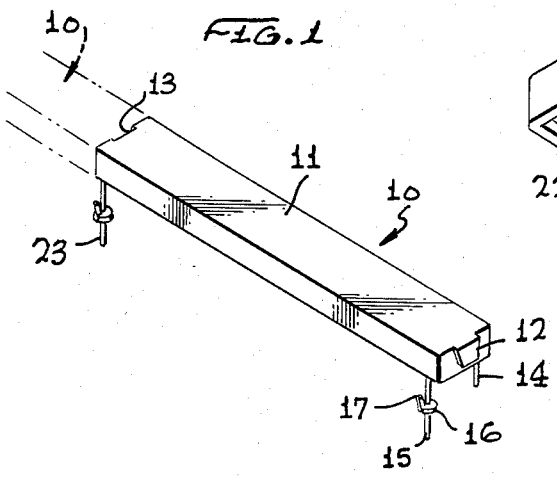
FIG. 1 is a front perspective view of a novel stepping rung used in the portable step arrangement of the present invention.

Referring to FIG. 1, a novel step rung incorporating the present invention is illustrated in the general direction of arrow 10 which includes an elongated member 11 composed of a lightweight, rigid material such as plastic or the like. Preferably, the upper surface of member 11 is flat and may be smooth or may carry a roughened surface so as to prevent skidding or slipping of a person negotiating the arrangement of steps. The step rung 11 includes opposite ends having a tapered projection 12 constituting a wedge carried beyond the edge or periphery at one end of the member and a groove 13 formed in the end of the opposite end of member 11. When it is desired to arrange a plurality of rungs in a side-by-side arrangement, the adjacent ends are connected together by inserting the wedge 12 into the groove or receptacle 13 associated with other step rung. Because of the conforming and corresponding wedge and groove shapes, the ends of the rungs will be connected together.

Each end of the member 11 is formed with a pair of spikes such as spikes 14 and 15 associated with one end of member 11. The opposite end of the member includes an identical pair of spikes. Each pair of spikes includes a penetration limit means such as ring 16 carried on spike 15 which is releasably held at a selected position along the length of the spike by a rotating latch 17.

Figure 2:
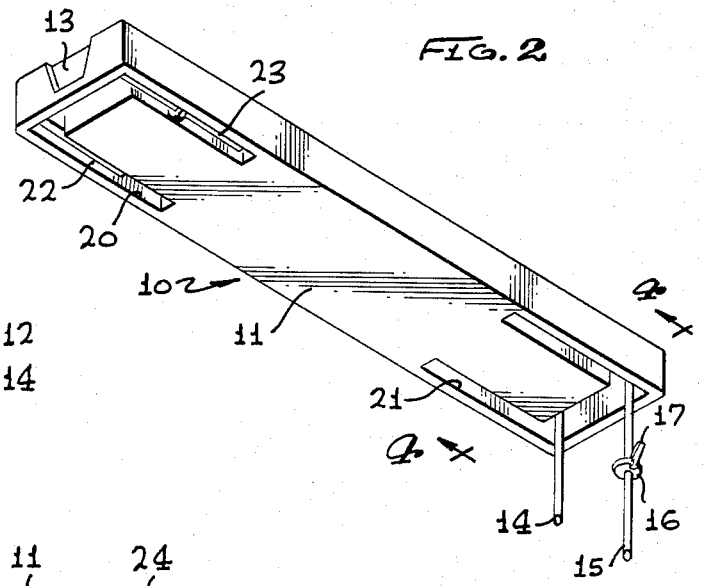
FIG. 2 is a perspective view showing the underside of the step rung illustrating a pair of spikes deployed for ground engagement.

Referring now in detail to FIG. 2, it can be seen that the opposite ends of the member 11 are provided with shaped recesses or receptacles braodly indicated by numerals 20 and 21 respectively for insertably receiving the pairs of spikes for storage purposes. In FIG. 2, the spikes 14 and 15 are deployed in a downward position ready for insertion into the ground while the pair of spikes on the opposite end of member 11 and indicated by numerals 22 and 23 are deployed within the shaped recess 20 for storage.

Figure 3:
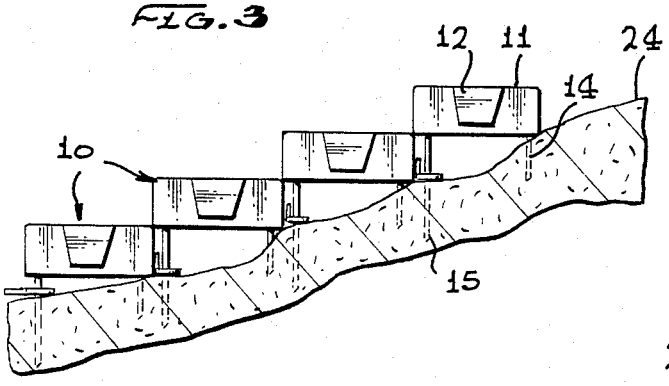
FIG. 3 is an arrangement of portable stepping rungs used in a stepping arrangement across uneven terrain forming a slope or incline surface.

Referring now in detail to FIG. 3, it can be seen that a plurality of step rungs are arranged in parallel relationship so that a set of steps are defined along an inclined slope broadly indicated by numeral 24. It is important to note that the rear lower edge of each step rung is supported against the ground while the forward side of the step rung is elevated above the ground surface by means of the spike 15. Each spike 15 on each pair is substantially longer than the rear spike 14 of each pair which is considerably shorter. In order to support the forward side of each step, the spike 15 is introduced into the soil until engagement is made by the limit stop ring 16. At this point, the latch 17 is actuated to bind against the spike so that the ring 16 cannot slide or move along the length of the spike. The step rung is now in place and ready for use.

Figure 4:
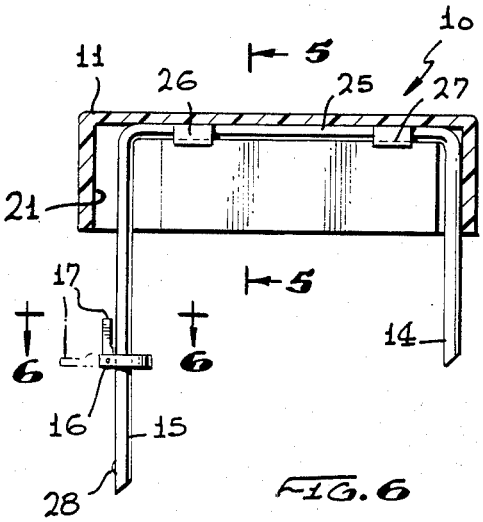
FIG. 4 is a transverse cross-sectional view of the stepping rung shown in FIG. 2 as taken in the direction of arrows 4—4 thereof.
Figure 5:
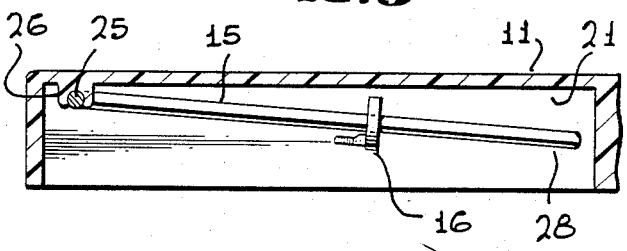
FIG. 5 is a sectional view as taken in the direction of arrows 5—5 of FIG. 4 showing the spike in a stowed position.

Referring now in detail to FIG. 4, it can be seen that the spikes 14 and 15 are integrally formed in a U-shaped configuration and that the crosspiece 25 joining the ends of the two spikes together serves as a pivot within retainers 26 and 27 coupled to the member 11. Also, it can be seen that the length of spike 15 is substantially longer than the rear spike 14. Inasmuch as spike 15 carries the penetration limiting means 16 thereon, a dimple 28 is integrally formed near the sharpened point of the spike to prevent the limit ring 16 from sliding from the spike when the latch 17 is in the unlatched position as shown in solid lines.

Figure 6:
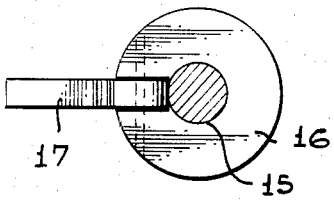
FIG. 6 is a transverse cross-sectional view of the spike and limiting means for ground penetration as taken in the direction of arrows 6—6 of FIG. 4.
Figure 7:
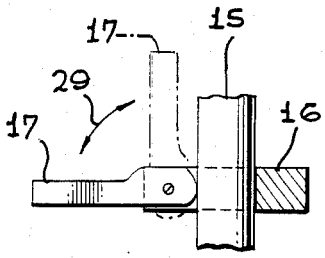
FIG. 7 is a perspective view, partly in section, of the limiting means shown in FIG. 6.

Referring to FIGS. 6 and 7, the penetration limit means or ring 16 is illustrated with the latch 17 shown in the releasable lock position in solid lines. When the latch 17 is moved according to the arrow 29, the ring is locked and unlocked on the length of the spike 15.

Figure 8:
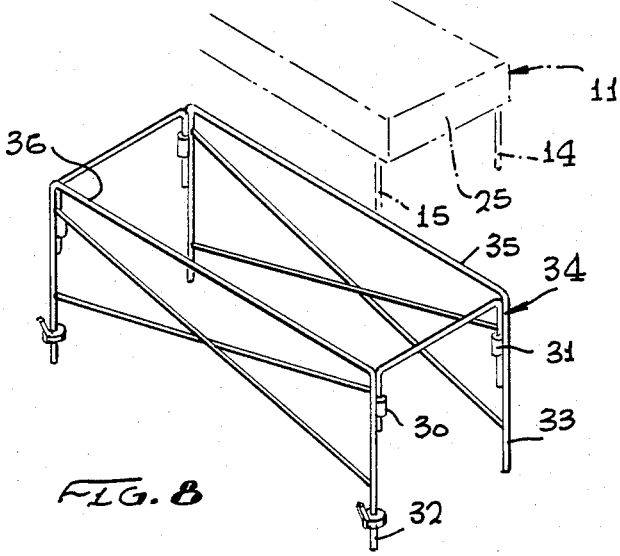
FIG. 8 is a perspective view of a base or frame for supporting a step rung in position to be used as a temporary seat or bench.

Referring now in detail to FIG. 8, the step rung 11 may be used as a seat or a bench by installing the spikes 14 and 15 into receptacles, such as receptacles 30 and 31 carried on the inside legs 32 and 33 of a base or a frame 34. When the rung or member 11 is installed on the base or frame 34, the underside of member 11 will lift on the horizontal elements 35 and 36 of the frame while the respective spikes at each end of member 11 are seated in the receptacles 30 and 31 associated with the legs on each end of the base or frame 34. As described earlier, a ground limit penetration means is carried on at least one leg at each end of the frame to limit penetration of the spikes into the ground.

Therefore, in view of the foregoing, it can be seen that a set of steps or an arrangement of steps is provided by arranging a plurality step rung 11 into side-by-side parallel relationship. The spikes associated with each end of each rung is introduced into the soil and pressed downwardly until the rear edge of the step rung engages the ground and the front end is limited by the ring 16.

For storage purposes, the spikes are pivoted on the retainers 26 and 27 so as to occupy the shaped storage recess associated with each end of the member 11.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. Portable steps comprising:

a plurality of elongated step rungs arranged adjacent to each other in parallel side-by-side relationship;

each step rung of said plurality including an elongated rigid member intended to be stepped upon incorporating a pair of ground engaging spikes at each end of said member for penetrating into the ground for a given length;

an adjustable gauge movably carried on said spikes adapted to engage with the ground to limit penetration of said spikes therein;

means for pivotally coupling said spikes at each end of said member so as to swing between a stowed position and an operative position for penetrating the ground; and recesses provided in each end of said member for insertably receiving said spikes and intended to be occupied by said spikes in their stowed position.

2. The invention as defined in claim 1 wherein:

said recesses correspond to the shape and configuration of said spikes so that said spikes nest within said recesses in said stowed position.

* * * * *